United States Patent [19]

Keneman et al.

[11] 4,182,968

[45] Jan. 8, 1980

[54] ELECTRON MULTIPLIER WITH ION BOMBARDMENT SHIELDS

[75] Inventors: Scott A. Keneman, Trenton; John G. Endriz, Plainsboro, both of N.J.

[73] Assignee: RCA Corporation, New York, N.Y.

[21] Appl. No.: 679,841

[22] Filed: Apr. 23, 1976

[51] Int. Cl.[2] ..... H01J 43/10; H01J 43/20

[52] U.S. Cl. ..... 313/105 R; 313/400

[58] Field of Search ..... 313/105 R

[56] References Cited

U.S. PATENT DOCUMENTS

| | | | |
|---|---|---|---|
| Re. 20,545 | 11/1937 | Jarvis et al. | 313/105 X |
| 2,231,682 | 2/1941 | Rajchman et al. | 313/105 |
| 2,231,691 | 2/1941 | Snyder | 313/105 |
| 2,274,092 | 2/1942 | Pierce | 313/105 |
| 3,904,923 | 9/1975 | Schwartz | 313/105 X |

*Primary Examiner*—Robert Segal

*Attorney, Agent, or Firm*—Glenn H. Bruestle; George E. Haas; Vincent J. Coughlin, Jr.

[57] ABSTRACT

A chain of planar dynodes is divided into two groups which are spaced from and substantially parallel to each other. A cathode which is capable of emitting electrons upon ion bombardment is at one end of the dynode chain. An envelope encloses the dynodes and the cathode. Also enclosed by the envelope are a plurality of shields. Each shield is located so as to prevent gas ions, present within the envelope, from striking the dynodes, while allowing the ions to strike the cathode.

2 Claims, 3 Drawing Figures

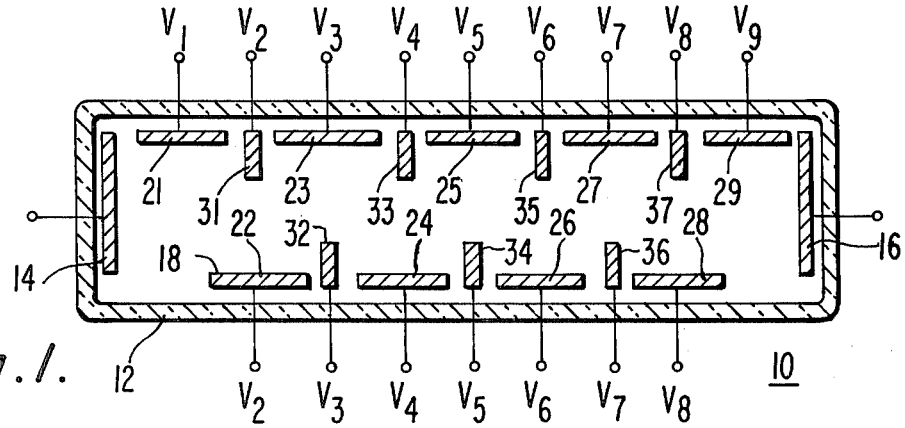
Fig. 1.
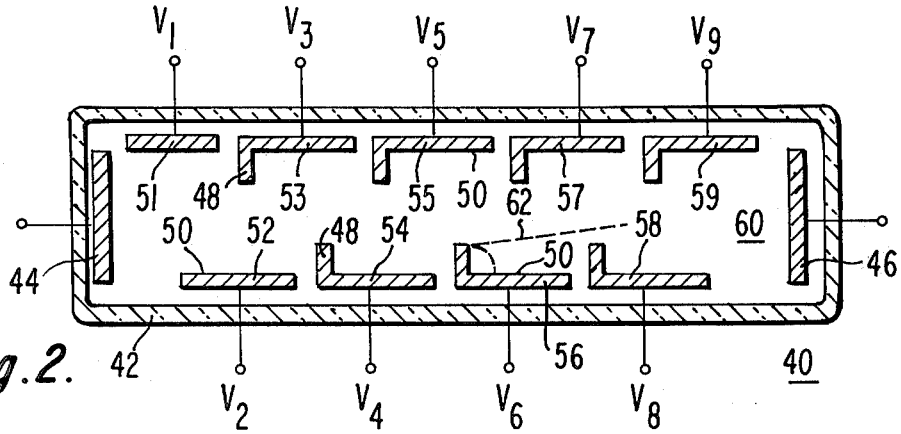
Fig. 2.
Fig. 3.
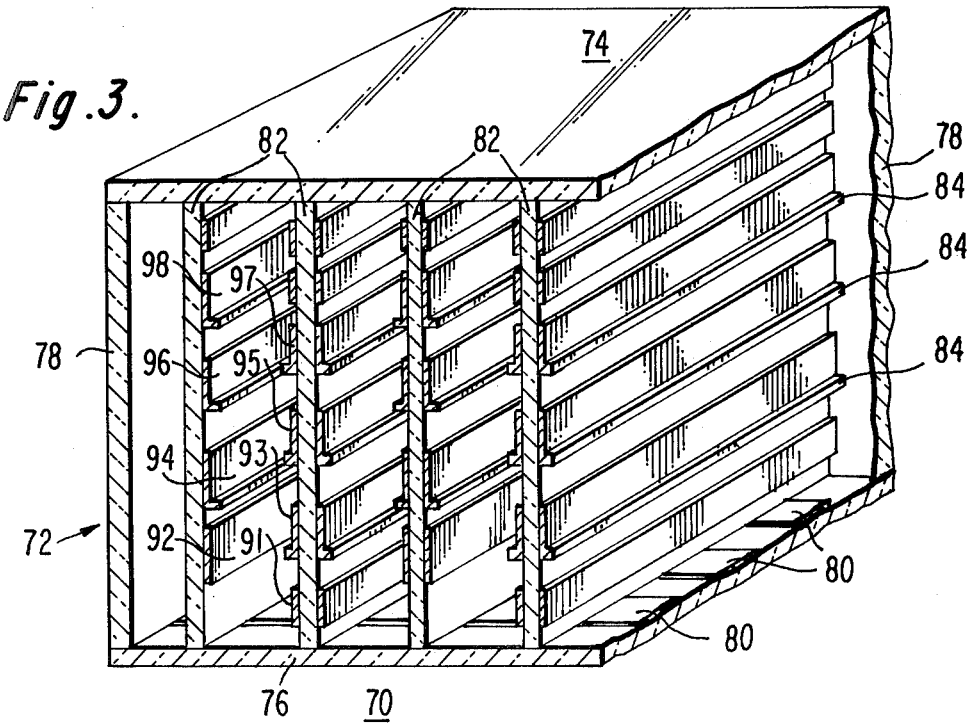

ELECTRON MULTIPLIER WITH ION BOMBARDMENT SHIELDS

BACKGROUND OF THE INVENTION

The present invention relates to electron multipliers which employ ion feedback and more particularly to such devices having means for preventing the ions from striking the electron emissive regions of the dynodes of the multiplier.

Various types of cathodoluminescent image display devices have been recently suggested employing ion feedback electron multipliers as electron sources. Such devices incorporate flat electron multipliers, each formed by a dynode chain having a cathode at one end and some form of cathodoluminescent screen at the other end. In these devices, the electrons in the first multiplier stages are amplified forming many electrons in the final stage, which in turn strike residual gas molecules in the atmosphere of the device converting the molecules to positive ions. These ions travel to the cathode which is coated with a secondary emissive material. The ions bombard the cathode emitting additional electrons which travel to the first stages of the electron multiplier completing a feedback loop.

The device can achieve self-sustained electron emission if the gain of the feedback loop gain exceeds one. In this case, the device may be turned on and off by controlling the electrical potentials applied to the dynodes or the cathode so as to switch the feedback loop gain above or below one respectively. It has been found, however, that the ions can strike the dynodes in the electron multiplier, as well as the cathode. When the ions strike the dynodes, additional electrons are given off, creating problems with respect to the on-off control of the device. The control of the device may be lost if the ions strike and create secondary electrons on higher stage dynodes than the dynode or the cathode whose potential has been changed. These secondary electrons will not be suppressed by the switching of lower dynode or cathode potentials. Thus a sustained electron emissive feedback loop may exist in the final stages which can not be turned off by potential changes at the cathode or the early multiplier stage dynodes. This control problem is most serious in certain applications where one desires to control the device only through potential changes on the cathode. In this situation, ion bombardment of the first multiplier stages can cause loss of cathode control. Such control problems can be avoided if this ion bombardment of the dynodes can be eliminated.

SUMMARY OF THE INVENTION

An ion feedback electron multiplier comprises a chain of planar dynodes divided into two groups. The groups are spaced from and parallel to each other. A cathode capable of emitting electrons upon ion bombardment is at one end of the dynode chain. The cathode and the dynode chain are enclosed by an envelope. Also within the envelope is means for preventing ions from bombarding at least some of the dynodes. Such a means, however, do not significantly inhibit the electron flow through the dynode chain or the ion flow to the cathode.

BRIEF DESCRIPTION OF THE DRAWING

FIG. 1 is a cross-sectional view of one embodiment of an electron multiplier according to the present invention.

FIG. 2 is a cross-sectional view of another embodiment of the present invention.

FIG. 3 is a cross-sectional view of an array of electron multipliers according to the present invention.

DETAILED DESCRIPTION OF THE INVENTION

With initial reference to FIG. 1, an electron multiplier, generally designated as 10, has a tubular envelope 12. Enclosed by the envelope 12 is a cathode 14, a dynode chain formed by nine planar dynodes 21–29, a plurality of ion shields 31–37 and an electron collection means 16. Each of the dynodes 21–29 is planar and has its surface coated with a material which is secondary electron emissive, such as MgO. The dynodes 21–29 are divided into two groups which extend along the longitudinal axis of the envelope 12 and are spaced from and parallel to one another. The first, third, fifth, seventh and ninth dynodes 21, 23, 25, 27 and 29 respectively, are in one group and the second, fourth, sixth and eighth dynodes 22, 24, 26 and 28 are in the other group. The dynodes 21–29 form an electron multiplier dynode chain. At one end of the dynode chain is the cathode 14 whose surface is coated with a material which emits electrons upon ion bombardment, such as MgO or BeO. At the opposite end of the dynode chain is a means for collecting electrons 16, such as a cathodoluminescent screen. Conventional terminology refers to each dynode as a stage of the multiplier, with the adjectives early or later referring to the stage's proximity to the cathode.

Positioned between adjacent dynodes in each group is a shield 31–37. Each shield extends into the space between the two groups of dynodes. The distance with the shields extend between the two groups of dynodes is dependent upon a number of factors, such as the distance between the two groups of dynodes and the interdynode distance. However, the distance which the shields extend should be kept to a minimum in order to protect the adjacent dynode from ion bombardment without appreciably inhibiting either the flow of electrons from dynode to dynode or the flow of ions back to the cathode 14. Most of the ions striking a dynode have a trajectory which nearly grazes the dynode immediately preceding the struck dynode. Therefore, these ions can be easily intercepted by shields that extend from each plane of the dynode surfaces 18 approximately 1/6 the distance between the two groups of dynodes.

The potential applied to each dynode in a conventional multiplier increases as the collection means 16 is approached. The shields may be maintained at various potentials in relation to the dynode potential. In the embodiment shown in FIG. 1, the shields 31–37 are maintained at the potential of the dynode directly opposite the shield as indicated by voltages $V_1$–$V_9$. Specifically, the first shield 31 is maintained at the potential of the second dynode 22 and the second shield 32 is maintained at the potential of the third dynode 23 and so on. In an alternative potential distribution, the shields 31–37 are maintained at the potential of the adjacent dynode which is farther from the cathode 14. In this second variation, the first shield 31 is maintained at the potential of the third dynode 23. The second shield 32 would be maintained at the potential of the fourth dynode 24 and so on through the dynode chain.

FIG. 2 shows an alternate, preferred embodiment of the present invention. In this embodiment, an electron multiplier designated 40 has an envelope 42 enclosing a cathode 44, a plurality of dynodes 51–59 and an electron collection means 46. The dynodes are divided into two spaced parallel groups. The electron multiplier 40 is similar to the multiplier 10 in FIG. 1, except that the ion bombardment shields are incorporated onto the dynode structure. The first and second dynodes 51 and 52 can be planar and similar to the first and second dynodes 21 and 22 in the device 10 in FIG. 1. The remainder of the dynodes 53–59 have an L-shaped structure. The short portion 48 of the L-shaped dynodes 53–59 form the ion bombardment shields and project into the space between the parallel groups of dynodes. The elongated portion of the L structure forms the emissive surface of the dynode. The dynodes 51–59 may be coated with a secondary emissive material, such as MgO. Since each ion bombardment shield is incorporated into the structure of a dynode, the shield is maintained at the potential of that dynode. This potential distribution is equivalent to the second variation described in reference to the multiplier 10 of FIG. 1.

As noted before, the distance which the ion shields 48 extend into the region between the two groups of dynodes depends upon a number of factors. The following specific example is illustrative of the dimension proportionality between the various elements. With respect to the embodiment of FIG. 2, the distance between the two groups of dynodes may be about one millimeter. The shields may extend 0.17 millimeters from the dynode surface 50. Each dynode may have a width of about one millimeter and be spaced about 0.4 millimeters from the adjacent dynodes. The ratio of dynode width to the group spacing should be about 1:1 and the ratio of dynode spacing to group spacing should be about 0.4:1.

In the present invention, the cathode emits electrons which travel to and strike the first dynode. The dynodes in the multiplier chain are spaced and biased so that the electrons will flow from one dynode to the next dynode and increase in number with each stage, as is well known in the art. For example, the electrons emitted by the first dynode will strike the second dynode which emits a greater number of electrons than the number which strike it. The electrons from the second dynode will strike the third dynode and so on through the dynode chain. In the particular embodiment shown in FIG. 2, each dynode has an active multiplying region which comprises approximately the half of the surface 50 which is closest to the collection means 46. The electrons that strike this latter half of the surface 50 have the highest probability of generating secondary electrons which will travel to the next dynode in the chain. The electrons emitted from the first half of the surface 50 have an extremely low probability of reaching the next dynode in the chain. The majority of the electrons emitted by the ninth dynode will strike the collecton means 46.

A few of the electrons emitted by the latter dynode stages will strike gas molecules in the envelope changing the molecules to positive ions. The positive ions travel at high velocities toward the cathode. These ions strike the cathode emitting additional electrons completing a feedback loop. Some of the generated ions do not reach the cathode but strike other parts of the device. The shields prevent the ions from striking the dynodes and generating electrons which will travel to the next dynode. In particular, an ion traveling from the output region 60 of the multiplier can strike the surface of the ion shield on the sixth dynode 56, as indicated by the dashed line 62. This ion can create an ion induced secondary electron which may strike the first half of the surface 50 of the sixth dynode. However, these electrons will strike the sixth dynode's surface at very low secondary emission energies, producing few, if any, secondary electrons. If the shield 48 was not present on the sixth dynode 56, the ion could reach the latter half of the fourth dynode 54. Any secondary electron emitted by this ion would have a high probability of reaching the fifth dynode 55 resulting in electron multiplication through the dynode stages.

Without the ion shields, it would become difficult to turn off a high gain feedback electron multiplier without controlling the potential applied to the latter stage dynodes. In this case, even though the cathode or early dynodes were turned off, the ion feedback could continue since ions could strike the mid or latter stage dynodes generating electrons. These electrons then would be multiplied through the electron multiplier and in turn generate more ions which would strike these same dynodes. As a result, feedback and electron emission could be sustained on the mid and latter stage dynodes. The ion shields prevent the ions from striking the dynodes and thereby prevent the ion feedback from continuing due to ion bombardment of the dynodes when the cathode or early stage dynodes are turned off. The multiplier can then be turned on and off by regulating only the voltage applied to the cathode or early stage dynodes which simplifies control circuitry and structure of the device.

It may not be necessary to place shields between all of the adjacent dynodes, particularly if the feedback multiplier is operated at a sufficiently low loop gain such that sustained feedback can only be attained through ion bombardment of the cathode or early stages. Under this condition, shields are only necessary in the region near the early stages of the electron multiplier. It is the ion bombardment of the early stages of the electron multiplier which has the greatest effect on device control, since secondary electrons generated in the early stages by ion bombardment of the dynodes, will be multiplied by each of the latter stages of the electron multiplier. The multiplication of these electrons gives rise to the formation of a considerable number of electrons. Electrons generated by ion bombardment of the mid or latter stages will not be multiplied sufficiently to generate a significant number of ions. Therefore, this mode of feedback can be largely ignored when considering control of devices having low loop gain.

These novel electron multipliers may be used singly or in arrays to form alphanumeric or image displays. When the multiplier is used in an array, the electron output of the multiplier may be used to illuminate one element of the display. The present invention has particular application in multi-cathode multiplier displays, such as the one shown in FIG. 3. In this embodiment, a matrix display device 70 has an envelope 72 comprising a cathodoluminescent screen 74 and a back panel 76 sealed together by walls 78. The interior surface of the screen 74 may be coated with a plurality of phosphor stripes (not visible). A plurality of parallel cathode stripes 80 are on the back panel 76. The cathode stripes 80 are composed of a material which will emit secondary electrons, such as MgO. A plurality of equally spaced parallel vanes 82 extend between the screen 74 and the back panel 76 orthogonal to the cathode stripes 80. The vanes are formed of an insulating material, such as glass and have a plurality of parallel dynode stripes 91–98 on their surfaces forming an electron multiplier (similar to the one in FIG. 2) between adjacent vanes. With the exception of the first two dynodes 91 and 92, each of the dynodes 93–98 have an L shape with the short portion of the L forming an ion shield projection 84 extending toward the adjacent vane.

The basic device without the ion shields and its operation are described in the copending application of John Endriz, et al. entitled, PARALLEL VANE STRUCTURE FOR FLAT IMAGE DISPLAY DEVICE, Ser. No. 672,122, filed on Mar. 31, 1976. In order to activate a particular element of the display, a single multiplier is activated by adjusting the dynode potentials so that the gain of the multiplier is sufficient to sustain feedback. A single display element along the full length of the multiplier is selected by adjusting the potential along the cathode stripe 80 opposite the display element, so that the cathode will emit electrons to the selected multiplier. The electrons are then multiplied and illuminate a portion of the screen 74 opposite the intersection of the activated cathode stripe 80 and the selected multiplier. Since the selection of one of the two matrix dimensions is accomplished through cathode switching, the ion shielded multiplier design of the present invention is desirable in achieving adequate control of the display.

We claim:

1. An ion feedback electron multiplier comprising:

an envelope;

means for generating ions within the envelope;

a plurality of dynodes in the envelope arranged in a chain comprising two groups of dynodes being spaced from and substantially parallel to each other;

a source of electrons within the envelope at one end of the dynode chain, the source being capable of emitting electrons upon ion bombardment; and means in the envelope for preventing ions from bombarding at least some of the dynodes without appreciably inhibiting the flow of electrons through the dynode chain or the flow of ions from the other end of the dynode chain toward the electron source, wherein said bombarding preventing means comprises a projection on at least some of the dynodes in each group, the projection extending into the space between the groups of dynodes from the end of the dynode which is nearest the electron source and toward the other group of dynodes for a distance of about 1/6 the distance between the groups of dynodes.

2. An ion feedback electron multiplier comprising:

an envelope;

means for generating ions within the envelope;

a plurality of dynodes in the envelope arranged in a chain comprising two groups of dynodes being spaced from and substantially parallel to each other;

a source of electrons within the envelope at one end of the dynode chain, the source being capable of emitting electrons upon ion bombardment; and means in the envelope for preventing ions from bombarding at least some of the dynodes without appreciably inhibiting the flow of electrons through the dynode chain or the flow of ions from the other end of the dynode chain toward the electron source, wherein said bombarding preventing means comprises a projection on at least some of the dynodes in each group, the projection extending into the space between the groups of dynodes from the end of the dynode which is nearest the electron source, and wherein the ratio of the dynode width to the space between the dynode groups is about 1:1 and the ratio of the space between adjacent dynodes to the space between the groups is about 0.4:1.

* * * * *